US012584678B2

(12) United States Patent
Scalf et al.

(10) Patent No.: US 12,584,678 B2
(45) Date of Patent: Mar. 24, 2026

(54) REFRIGERATOR WITH DYNAMIC MULTI-ZONE ANTI-SWEAT HEATING SYSTEM

(71) Applicant: Midea Group Co., Ltd., Foshan (CN)

(72) Inventors: Eric Scalf, Louisville, KY (US); Brian Langness, Shelbyville, KY (US)

(73) Assignee: MIDEA GROUP CO., LTD., Beijiao (CN)

( * ) Notice: Subject to any disclaimer, the term of this patent is extended or adjusted under 35 U.S.C. 154(b) by 861 days.

(21) Appl. No.: 17/215,349

(22) Filed: Mar. 29, 2021

(65) Prior Publication Data

US 2022/0307756 A1 Sep. 29, 2022

(51) Int. Cl.

*F25D 21/02* (2006.01)
*F25D 21/14* (2006.01)
*F25D 29/00* (2006.01)

(52) U.S. Cl.

CPC ..... *F25D 21/02* (2013.01); *F25D 21/14* (2013.01); *F25D 29/008* (2013.01); *F25D 2321/1413* (2013.01); *F25D 2600/00* (2013.01); *F25D 2700/14* (2013.01)

(58) Field of Classification Search

CPC ..... F25D 21/02; F25D 21/04; F25D 21/08; F25D 21/14; F25D 23/02; F25D 2700/12; F25D 2400/02

See application file for complete search history.

(56) References Cited

U.S. PATENT DOCUMENTS 4,127,765 A * 11/1978 Heaney ..... H05B 3/84 49/70
4,260,876 A * 4/1981 Hochheiser ..... G05D 23/24 219/203
4,548,049 A 10/1985 Rajgopal
4,808,009 A * 2/1989 Sittler ..... G01K 7/223 374/25
4,843,833 A * 7/1989 Polkinghorne ..... F25D 17/065 62/126
5,778,689 A 7/1998 Beatenbough
6,220,039 B1 4/2001 Kensok et al.
6,226,995 B1 5/2001 Kalempa et al.

(Continued)

FOREIGN PATENT DOCUMENTS

CN 101988780 A 3/2011
CN 102519214 A 6/2012

(Continued)

OTHER PUBLICATIONS

GreenWize Energy Solutions, Anti-Sweat Heater Control for Low Temp Glass Display Doors, Retrieved from: hillphoenix.com/display-case/energy-reduction-solutions/, 2016.

(Continued)

*Primary Examiner* — Jianying C Atkisson
*Assistant Examiner* — Meraj A Shaikh
(74) *Attorney, Agent, or Firm* — Gray Ice Higdon

(57) ABSTRACT

A dynamic multi-zone anti-sweat heating system may be used in a refrigerator to reduce moisture on various surfaces of the refrigerator. Moreover, in some instances, the determination of when moisture is present and/or absent from a surface may be made based at least in part on detection of the presence or absence of an elevated thermal load on the surface while a heater is activated.

25 Claims, 6 Drawing Sheets

(56) References Cited

U.S. PATENT DOCUMENTS

| | | | | |
|---|---|---|---|---|
| 7,340,907 | B2 | 3/2008 | Vogh, III | |
| 8,250,873 | B2 | 8/2012 | Yoon et al. | |
| 8,434,317 | B2 | 5/2013 | Besore | |
| 8,539,783 | B1 | 9/2013 | Bunch | |
| 9,291,383 | B2 | 3/2016 | Besore | |
| 10,655,904 | B2 | 5/2020 | Aiken et al. | |
| 2005/0229614 | A1 | 10/2005 | Ansted | |
| 2010/0024462 | A1* | 2/2010 | Kamisako | A23L 3/3409 62/331 |
| 2012/0000899 | A1 | 1/2012 | Eom | |
| 2012/0042676 | A1 | 2/2012 | Graham | |
| 2012/0047919 | A1 | 3/2012 | Besore | |
| 2014/0216706 | A1 | 8/2014 | Melton et al. | |
| 2014/0260360 | A1* | 9/2014 | Rasch | A47F 3/0478 62/80 |
| 2015/0285551 | A1* | 10/2015 | Aiken | A47F 3/0478 62/155 |
| 2016/0025404 | A1 | 1/2016 | Zheng | |
| 2016/0356539 | A1 | 12/2016 | Chung et al. | |
| 2017/0020305 | A1* | 1/2017 | Fischer | F25D 21/14 |
| 2017/0219269 | A1 | 8/2017 | Ahn | |
| 2018/0045452 | A1* | 2/2018 | Ji | F25D 17/08 |
| 2020/0191464 | A1* | 6/2020 | Avhale | F25D 21/04 |
| 2022/0259031 | A1* | 8/2022 | Gracki | F25D 23/028 |

FOREIGN PATENT DOCUMENTS

| | | | |
|---|---|---|---|
| CN | 110108080 | A | 8/2019 |
| CN | 110173947 | A | 8/2019 |
| JP | S5080558 | A | 6/1975 |
| JP | 2001147074 | A | 5/2001 |
| JP | 2011257025 | A | 12/2011 |

OTHER PUBLICATIONS

Hilliphoenix, Sweat Miser, Retrieved from: https://www.hillphoenix.com/display-case/energy-reduction-solutions/, 2016.

International Searching Authority; International Search Report and Written Opinion; Issued in Application No. PCT/CN2022/083169; 6 pages; dated Jun. 22, 2022.

European Patent Office, Partial Supplementary European Search Report issued in Application No. EP22778803.1, 7 pages, dated Aug. 7, 2023.

European Patent Office, Extended European Search Report issued in Application No. 22778803.1, 10 pages, dated Nov. 7, 2023.

European Patent Office, Intention to Grant issued in Application No. 22778803.1, 72 pages, dated Nov. 28, 2024.

* cited by examiner

REFRIGERATOR WITH DYNAMIC MULTI-ZONE ANTI-SWEAT HEATING SYSTEM

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Due to the varying environmental conditions, such as varying temperatures and/or humidity levels, various exterior surfaces of a refrigerator may be subject to condensation, resulting in moisture undesirably forming on those surfaces.

Many residential refrigerators also include as a convenience feature an integrated dispenser for dispensing a fluid (e.g., water) and/or ice. Such dispensers may also be externally accessible, and often include a sump or tray that collects any dispensed ice and/or water that has dripped or spilled from the dispenser during or after dispensing ice and/or water into a container. Dispensers are also prone to condensation in some instances, particularly when ice is being dispensed and cold air is expelled from the dispenser with the ice.

Condensation generally forms on a surface whenever the temperature of the surface drops below the dew point of the air surrounding the surface, and as a result, many refrigerators incorporate various heating devices capable of supplying heat to various surfaces to inhibit condensation. Heat generated by the condenser of a refrigerator cooling system as an inherent byproduct of the refrigeration process may be used in some areas of a refrigerator (e.g., via tubing extensions from the condenser); however, in many areas of a refrigerator, particularly on the doors or on other moving parts in a refrigerator, electric heaters are used to heat surfaces that are potentially subject to condensation. The use of electric heaters, however, increases energy consumption, so it is generally desirable to limit the use of such heaters only to circumstances where condensation has or is likely to be formed. Conventional refrigerators, however, rely either on user selection of an energy saver function or on preprogrammed algorithms that run generally any time the cooling system is active. In either case, however, a risk exists that condensation may occur.

SUMMARY

The herein-described embodiments address these and other problems associated with the art by utilizing a dynamic multi-zone anti-sweat heating system in a refrigerator to reduce moisture on various surfaces of the refrigerator. Moreover, in some instances, the determination of when moisture is present and/or absent from a surface may be made based at least in part on detection of the presence or absence of an elevated thermal load on the surface while a heater is activated.

Therefore, consistent with one aspect of the invention, a refrigerator may include a cabinet including one or more food compartments and one or more doors providing external access to the one or more food compartments, a surface heater positioned to heat a surface of the cabinet, a temperature sensor positioned to sense a temperature for the surface, and a controller coupled to the surface heater and the temperature sensor, the controller configured to detect moisture on the surface by activating the surface heater, sensing temperature with the temperature sensor, and determining that moisture is present on the surface in response to detecting an elevated thermal load on the surface while the surface heater is activated.

Some embodiments may also include an articulating mullion disposed on one of the one or more doors, and the surface is disposed on the articulating mullion. Also, in some embodiments, the controller is further configured to generate an alert indicating that a door among the one or more doors has been left open in response to a temperature sensed by the temperature sensor. Further, in some embodiments, the controller is further configured to generate an alert indicating that a gasket of a door among the one or more doors may be disrupted in response to a temperature sensed by the temperature sensor.

Some embodiments may further include an externally-mounted dispenser disposed on the cabinet and including a dispenser recess sump, and the surface is disposed on the dispenser recess sump. In some embodiments, the controller is further configured to generate an alert indicating a presence of fluid in the dispenser recess sump in response to a temperature sensed by the temperature sensor.

In addition, in some embodiments, the surface is a first surface, the surface heater is a first surface heater, the temperature sensor is a first temperature sensor, the refrigerator further includes a second surface heater positioned to heat a second surface in a dispenser recess and a second temperature sensor positioned to sense a temperature for the second surface, and the controller is further configured to separately activate the first and second surface heaters based upon moisture respectively detected on the first and second surfaces.

In some embodiments, the surface is a first surface, the surface heater is a first surface heater, the temperature sensor is a first temperature sensor, the refrigerator further includes a second surface heater positioned to heat a second surface of the cabinet and a second temperature sensor positioned to sense a temperature for the second surface, and the controller is further configured to detect moisture on the second surface and to separately activate the first and second surface heaters based upon moisture respectively detected on the first and second surfaces. Some embodiments may also include an evaporative tray disposed on the cabinet, and the surface is disposed on the evaporative tray.

In some embodiments, the controller is configured to determine the elevated thermal load based upon a rate of temperature rise during activation of the surface heater. In addition, in some embodiments, the controller is configured to determine the elevated thermal load based upon a comparison of temperature rise with applied current to the heater.

Moreover, in some embodiments, the controller is further configured to predict a likelihood of condensation forming on the surface based upon the temperature sensed by the temperature sensor, and to activate the surface heater in response to predicting that condensation is likely to be forming on the surface. In some embodiments, the controller is further configured to predict the likelihood of condensation forming on the surface based upon ambient temperature and/or humidity sensed by one or more additional sensors of the refrigerator. Moreover, in some embodiments, the controller is configured to predict the likelihood of condensation by executing a prediction algorithm, and the controller is configured to dynamically execute the prediction algorithm in response to consumer or appliance behavior.

In some embodiments, the controller is configured to dynamically execute the prediction algorithm in response to detected ice retrieval, detected door opening, occupancy monitoring, sealed system cycling, fan operation and/or ice production. In addition, in some embodiments, the controller is configured to predict the likelihood of condensation by executing a prediction algorithm, and the controller is configured to dynamically execute the prediction algorithm in response to ambient monitoring or input received from an HVAC system. In some embodiments, the temperature sensor is integrated into the surface heater.

Consistent with another aspect of the invention, a refrigerator may include a cabinet including one or more food compartments and one or more doors providing external access to the one or more food compartments, the cabinet further including a fluid receptacle for receiving fluid, a heater positioned to heat the fluid receptacle, a temperature sensor positioned to sense a temperature proximate the fluid receptacle, and a controller coupled to the heater and the temperature sensor, the controller configured to activate the heater to evaporate fluid disposed in the fluid receptacle, and the controller further configured to automatically deactivate the heater when the fluid disposed in the fluid receptacle has been evaporated based upon the temperature sensed by the temperature sensor.

Some embodiments may further include an externally-mounted dispenser disposed on the cabinet, and the fluid receptacle includes a dispenser recess sump for the externally-mounted dispenser. Also, in some embodiments, the fluid receptacle includes an evaporative tray configured to collect condensation generated by a cooling system of the refrigerator.

In some embodiments, the controller is configured to determine when the fluid disposed in the fluid receptacle has been evaporated by determining a decrease in thermal load in the fluid receptacle while the heater is activated.

In addition, in some embodiments, the controller is configured to determine the decrease in thermal load by detecting an increased temperature rise during activation of the heater. Also, in some embodiments, the controller is configured to determine the decrease in thermal load based upon a comparison of temperature rise with applied current to the heater. Moreover, in some embodiments, the controller is further configured to detect moisture in the fluid receptacle in response to detecting an elevated thermal load in the fluid receptacle while the surface heater is activated.

Consistent with another aspect of the invention, a refrigerator may include a cabinet including one or more food compartments and one or more doors providing external access to the one or more food compartments, a plurality of surface heaters positioned to heat respective surfaces among a plurality of surfaces of the cabinet, a plurality of temperature sensors positioned to sense temperatures for respective surfaces among the plurality of surfaces, and a controller coupled to the plurality of surface heaters and the plurality of temperature sensors, the controller configured to detect moisture on a selected surface of the plurality of surfaces by activating the respective surface heater for the selected surface, sensing temperature with the respective temperature sensor for the selected surface, and determining that moisture is present on the selected surface in response to detecting an elevated thermal load on the selected surface while the surface heater for the selected surface is activated.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
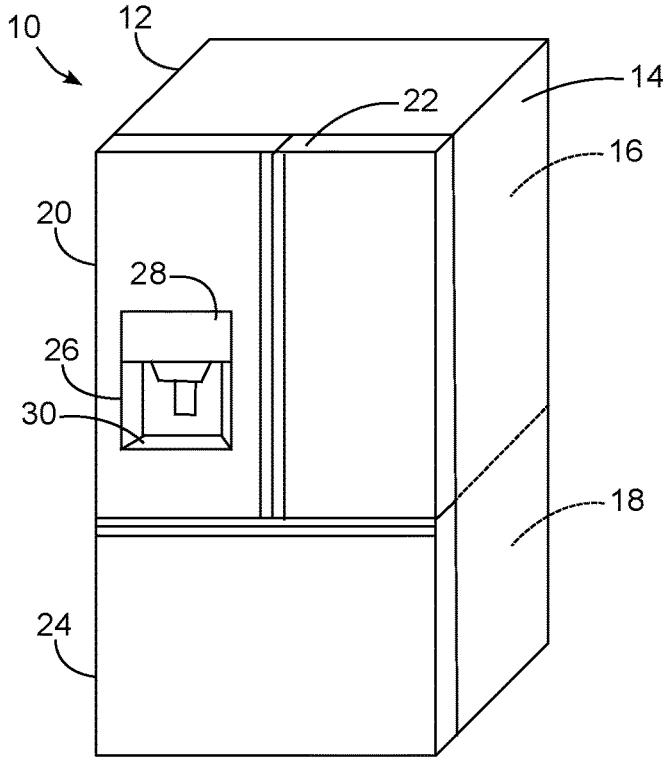
FIG. 1 is a perspective view of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet 12 including a main case 14 housing one or more food storage compartments (e.g., a fresh food compartment 16 and a freezer compartment 18), as well as one or more fresh food compartment doors 20, 22 and one or more freezer compartment doors 24 disposed adjacent respective openings of food storage compartments 16, 18 and configured to insulate the respective food storage compartments 16, 18 from an exterior environment when the doors are closed.

Fresh food compartment 16 is generally maintained at a temperature above freezing for storing fresh food such as produce, drinks, eggs, condiments, lunchmeat, cheese, etc. Various shelves, drawers, and/or sub-compartments may be provided within fresh food compartment 16 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 18 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, and includes a pair of side-by-side fresh food compartment doors 20,22 that are hinged along the left and right sides of the refrigerator to provide a wide opening for accessing the fresh food compartment, as well as a single sliding freezer compartment door 24 that is similar to a drawer and that pulls out to provide access to items in the freezer compartment. It will be appreciated, however, that other door designs may be used in other embodiments, including various combinations and numbers of hinged and/or sliding doors for each of the fresh food and freezer compartments. Moreover, while refrigerator 10 is a bottom mount refrigerator with freezer compartment 18 disposed below fresh food compartment 16, the invention is not so limited, and as such, the principles and techniques may be used in connection with other types of refrigerators in other embodiments.

Refrigerator 10 also includes a door-mounted dispenser 26 for dispensing ice and/or a fluid such as water. In the illustrated embodiments, dispenser 26 is an ice and water dispenser capable of dispensing both ice (cubed and/or crushed) and chilled water, while in other embodiments, dispenser 26 may be an ice only dispenser for dispensing only cubed and/or crushed ice, or a water only dispenser for dispensing only water. In still other embodiments, dispenser 26 may dispense hot water, coffee, beverages, or other fluids, and may have variable and/or fast dispense capabilities, as well as an ability to dispense predetermined or measured quantities of fluids. In some instances, ice and water may be dispensed from the same location, while in other instances separate locations may be provided in the dispenser for dispensing ice and water.

Refrigerator 10 also includes a control panel 28, which in the illustrated embodiment is integrated with dispenser 26 on door 20, and which includes various input/output controls such as buttons, indicator lights, alphanumeric displays, dot matrix displays, touch-sensitive displays, etc. for interacting with a user. In other embodiments, control panel 28 may be separate from dispenser 26 (e.g., on a different door), and in other embodiments, multiple control panels may be provided. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 16, 18. In addition, refrigerator 10 may be controllable remotely, e.g., via a smartphone, tablet, personal digital assistant or other networked computing device, e.g., using a web interface or a dedicated app.

Furthermore, as will be discussed in greater detail below, dispenser 26 may additionally include a dispenser recess sump 30 that is used to capture ice, water, or other fluids dispensed from dispenser 26. As will also be discussed in greater detail below, dispenser recess sump 30 may retain a volume of fluid for which it may be desirable to remove, e.g., through evaporation. In addition, due to the fact that cold water and ice may be dispensed by dispenser 26, as well as the fact that the dispenser recess (i.e., the portion under the dispenser outlet(s) that is recessed within door 20) is potentially exposed to lower temperatures and thus a greater risk of condensation, it may be desirable to incorporate an anti-sweat heating capability for the dispenser.

Figure 2:
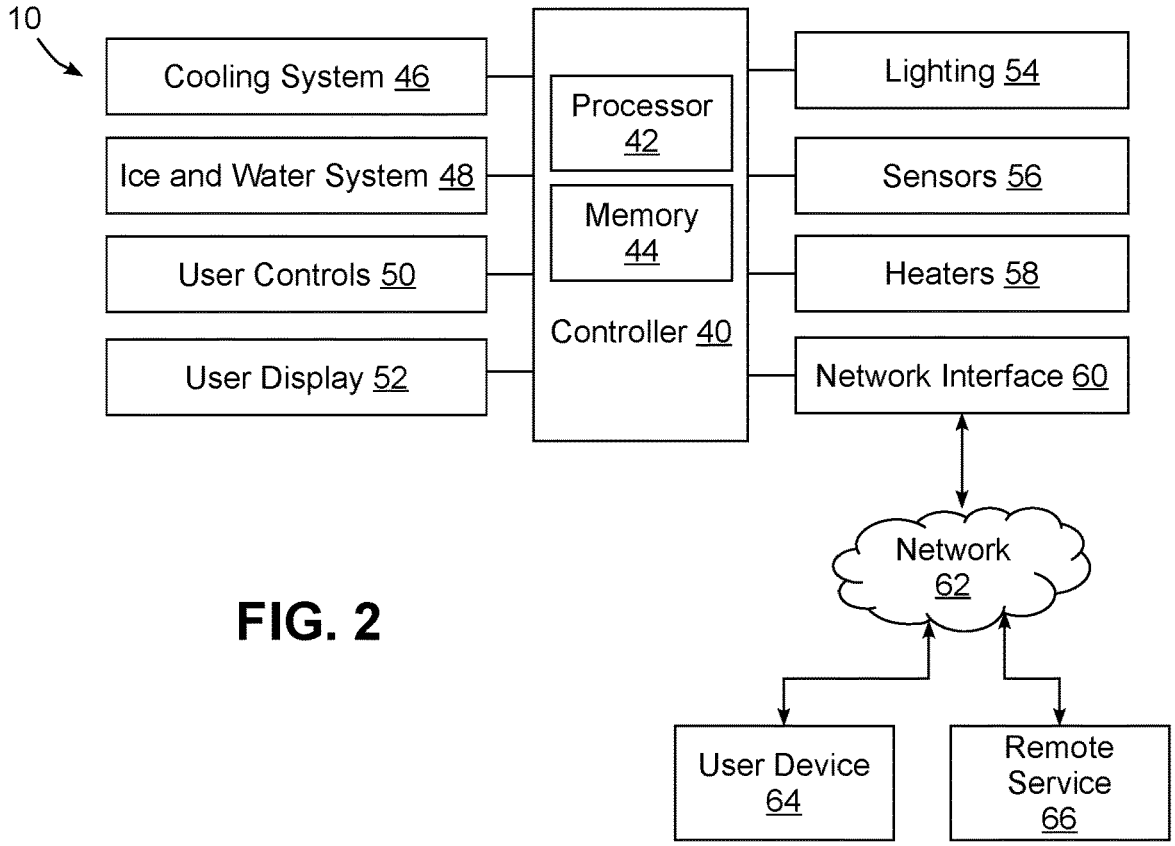
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40. Controller 40 may also be distributed among multiple controller circuits within refrigerator 12 in some embodiments, so the invention should not be considered to be limited to a controller implemented as a single central controller circuit as is illustrated in FIG. 2.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc., as well as one or more variable controls as discussed in greater detail below), and one or more user displays 52 (including various indicators, graphical displays, textual displays, speakers, etc.), as well as various additional components suitable for use in a refrigerator, e.g., interior and/or exterior lighting 54, among others.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments. In addition, controller 40 may be interfaced with one or more heaters 58, e.g., for use in a dynamic multi-zone anti-sweat heating system as described in greater detail herein.

In some embodiments, controller 40 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 64 over network 62, e.g., computers, tablets, smart phones, wearable devices, etc., and through which refrigerator 10 may be controlled and/or refrigerator 10 may provide user feedback. Refrigerator 10 may also be interfaced in some embodiments with one or more remote services 66, e.g., various cloud or remote computing services.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Dynamic Multi-Zone Anti-Sweat Heating System

Some embodiments consistent with the invention, as mentioned above, are directed in part to the use of a dynamic multi-zone anti-sweat heating system for inhibiting the formation of moisture on various surfaces of a refrigerator and/or to evaporate fluid collected in a refrigerator, e.g., in a dispenser recess sump, evaporative tray, or other fluid collection structure.

An anti-sweat heating system may be considered to be dynamic from the standpoint that, at least in some embodiments, the heating system is capable of dynamically activating one or more heaters in response to detection of the presence of moisture on a surface, or at least detection of conditions that are indicative of a likely presence of moisture on a surface. An anti-sweat heating system may be considered to be multi-zone from the standpoint that, at least in some embodiments, multiple individually-actuatable zones exist that can be independently monitored and activated to address potential moisture within such zones.

A zone, in particular, may include one or more heaters and one or more temperature sensors, and may cover one or more interior and/or exterior surfaces of a refrigerator cabinet (which, for the purposes of this disclosure, may include both the main case and the doors of the refrigerator, as well as any other component or structure in the refrigerator upon which it may be desirable to prevent condensation from forming and/to or evaporate any condensation or fluid that may exist). As such, in some embodiments a zone may encompass multiple surfaces, while in other embodiments one surface may have multiple zones.

The heaters in a zone may be heating elements capable of heating associated surfaces, and the temperature sensors may be surface temperature sensors capable of sensing a temperature on associated surfaces. Multiple heating elements within a zone may be supported in some embodiments, and the multiple heating elements may be disposed in the same heating assembly in some embodiments, or may be disposed in different heating assemblies. Further, in some embodiments, the heating elements may be considered to be surface heaters to the extent that the heat generated thereby provides heat to an associated surface. In addition, it will be appreciated that multiple zones may operate in a group in some embodiments, such that activities occurring within multiple zones of a group may be affect the activation of the heating elements in various zones in the group (e.g., as is the case with a dispenser recess as discussed below in connection with FIG. 7).

By utilizing multiple zones, each zone may be provided with individual temperature feedback, and the temperature feedback may be used to enable a controller to dynamically react to sensed temperature by selectively activating heaters. As such, in some embodiments zones may be monitored on an ongoing basis, with heaters activated on demand when needed, and only in zones within which moisture may be present, thereby minimizing overall energy usage.

In some embodiments, activation of a heater in a zone may be based on a dew point determined, for example, from a sensed ambient relative humidity, along with one or more surface temperature readings that detect when a surface temperature drops below a calculated dew point. In other embodiments, the temperature in each zone may be monitored to detect drops in temperature, which may be indicative of heat flux, and indicating the desirability of energizing a heater in a particular zone.

Furthermore, in some embodiments, moisture detection (and/or detection of removal of moisture) may be based in part on the evaporative cooling effect of moisture. In particular, in some embodiments moisture detection may be based at least in part on sensing the thermal load on a surface, in particular while a heater associated with the surface is active, as moisture present on a surface will generally present as a thermal mass that, when heated, will resist an increase in surface temperature as a result of the phase change occurring as the moisture evaporates. This resistance to change may be sensed, for example, by monitoring the rate of change of the sensed surface temperature, or alternatively by comparing a rate of change of the sensed surface temperature to an amount of applied current to a heater (e.g., by dividing temperature increase by applied amperage in some embodiments). Moisture may therefore be detected based upon a reduced or slower than expected rise in temperature when a heater is activated (i.e., an increased thermal load), while the evaporation of moisture may be detected based upon a transition to a faster temperature rise when a heater is activated (i.e., a decreased thermal load). Further, the detection of moisture in one zone or on one surface or portion of a surface could be used to trigger activation of heaters in other zones or associated with other surfaces, given that environmental conditions particularly suitable for condensation may have been detected.

Thus, in some embodiments consistent with the invention, a controller coupled to a heater and a temperature sensor may be able to detect moisture on a surface by activating the heater, sensing a surface temperature with the temperature sensor while the heater is activated, and determining that moisture is present on the surface in response to detecting an elevated thermal load on the surface while the surface heater is activated.

It will also be appreciated that, in addition to or in lieu of condensation formed on interior and/or exterior surfaces of a refrigerator, the techniques described herein may also be used to accelerate the evaporation of fluids collected in various receptacles in a refrigerator, e.g., a dispenser recess sump and/or an evaporative tray used to collect condensation generated by a refrigerator cooling system. In particular, heaters may be used to accelerate fluid evaporation, and monitored surface temperatures may be used to detect when fluid is present and/or when all of the fluid in a receptacle has been removed.

Figure 3:
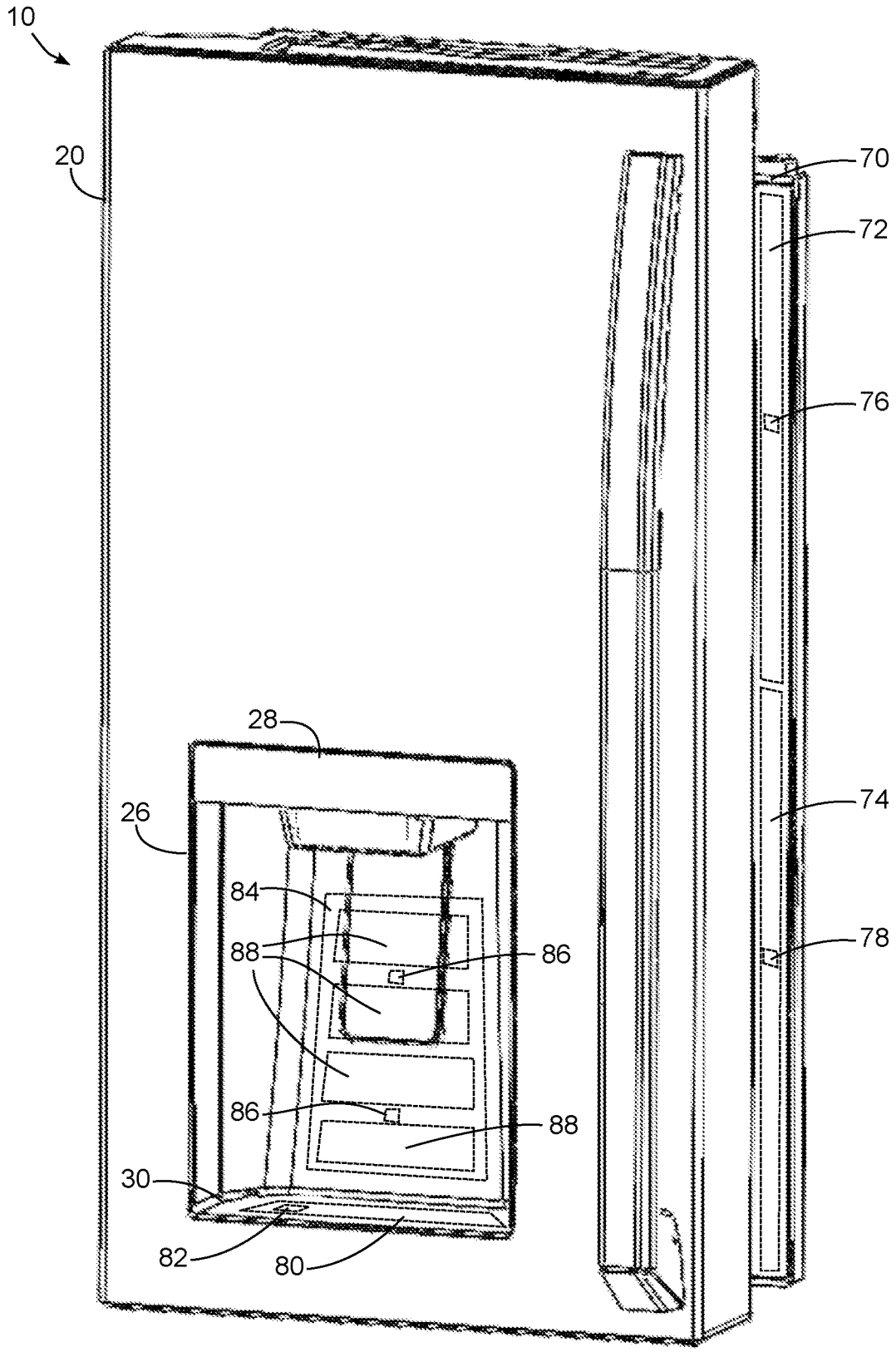
FIG. 3 is a perspective view of a door of the refrigerator of FIGS. 1-2.

Now turning to FIG. 3, it will be appreciated that a dynamic multi-zone anti-sweat heating system may be used in a number of different areas and applications within a refrigerator. FIG. 3 in particular illustrates door 20 of refrigerator 10 in greater detail, along with several potential zones that may be utilized in a heating system consistent with the invention.

One potential application of such a heating system is in connection with addressing condensation on an articulating mullion of a refrigerator door. Door 20, for example, is illustrated in FIG. 3 with an articulating mullion 70 including a pair of heaters 72, 74 and associated temperature sensors 76, 78 effectively defining two different zones on the articulating mullion 70, and suitable for addressing potential moisture condensation on the mullion, e.g., when the door is open. In addition, for dispenser recess sump 30, an associated heater 80 and temperature sensor 82 are illustrated, e.g., for evaporating fluids collected in the sump 30. Furthermore, for the recess of dispenser 26 itself, an additional zone may be defined including a heater 84 formed along a back wall of the recess, and proximate to a dispenser outlet from which cold air may escape and potentially cause an increase in the likelihood of condensation. FIG. 3 also illustrates that in some embodiments, a zone may include multiple temperature sensors, e.g., temperature sensors 86 disposed at different locations in the recess. Further, FIG. 3 also illustrates that in some embodiments, a heater such as heater 84 may include multiple heating elements 88, which may be separately or collectively activated in various embodiments.

Figure 4:
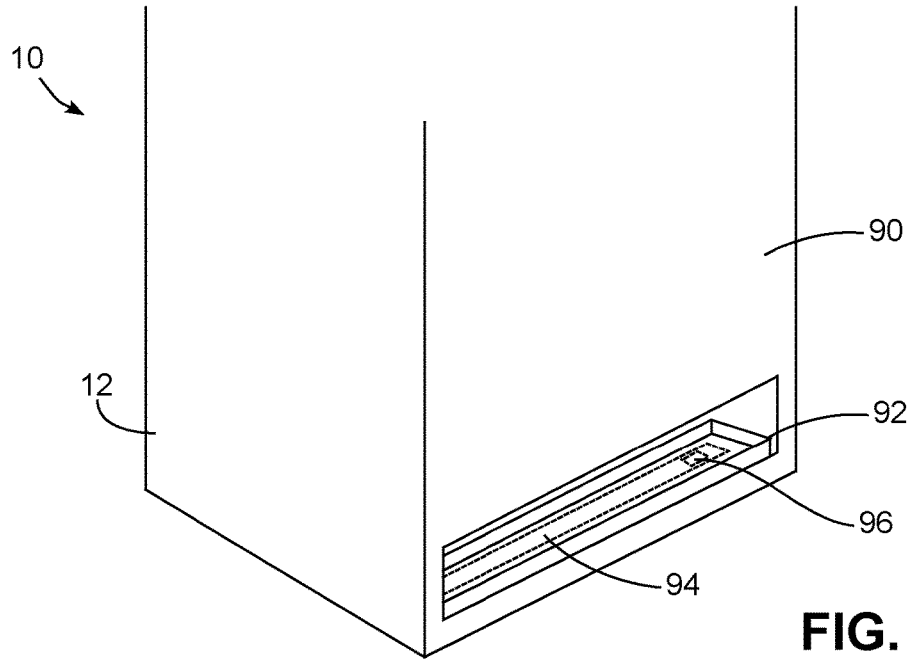
FIG. 4 is a perspective view of a portion of the rear of the refrigerator of FIGS. 1-2.

FIG. 4 illustrates an additional location for a zone in refrigerator 10, in particular, on the rear 90 of the refrigerator, where a evaporative tray 92 utilized by the cooling system may be located. A heater 94 and associated temperature sensor 96 may be used to accelerate evaporation of fluids collected in tray 92.

It will be appreciated that the various applications illustrated in FIGS. 3 and 4 are merely exemplary in nature, and that the techniques disclosed herein may be used in a wide variety of other applications, including, without limitation, interior and/or exterior surfaces of the case or doors, internal mullions, defrost heaters, duct door heaters, and compartment heaters (e.g., quick thaw compartments), among others.

Figure 5:
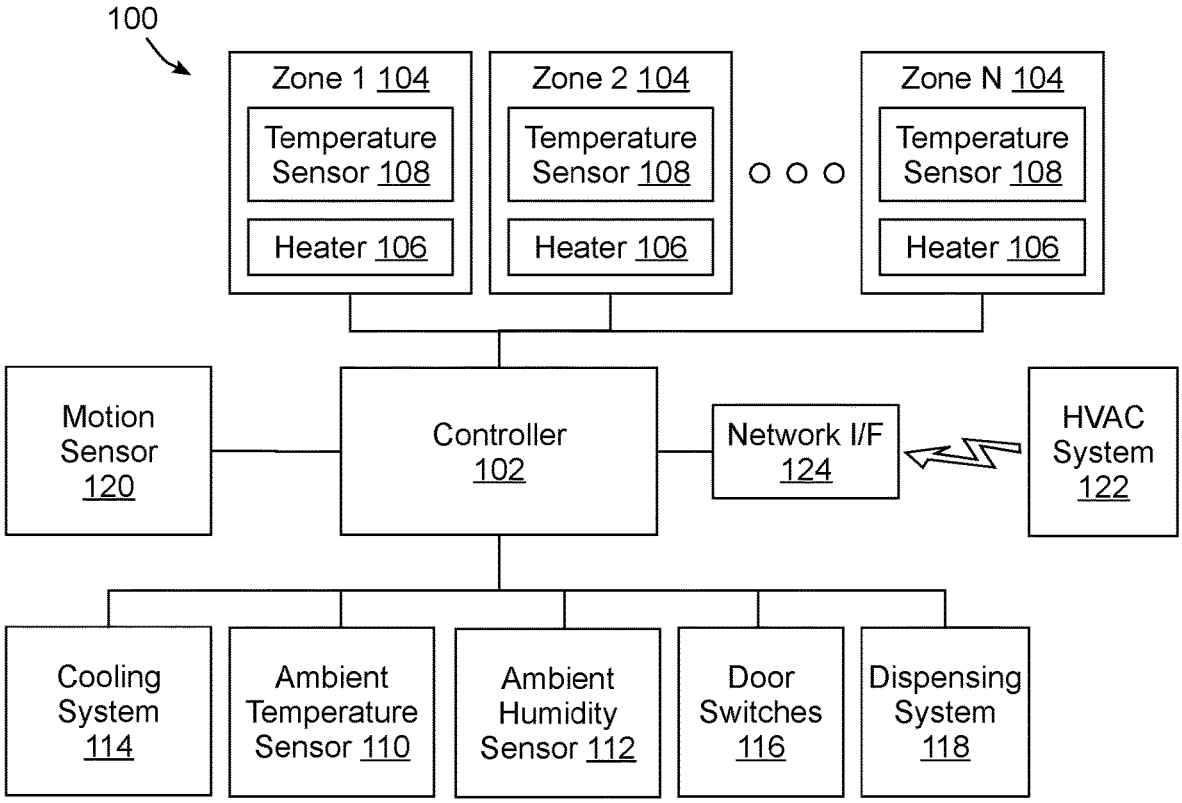
FIG. 5 is a block diagram illustrating a dynamic multi-zone anti-sweat heating system consistent with some embodiments of the invention.

Now turning to FIG. 5, an example dynamic multi-zone anti-sweat heating system 100 is illustrated in greater detail, and suitable for implementation, for example, in refrigerator 10. A controller 102 in particular is coupled to multiple zones 104, each including one or more heaters 106 and one or more temperature sensors 108. Each heater may be implemented using a number of different technologies suitable for the particular application of a zone. For example, resistive heating elements may be printed on flexible substrates or directly on or underneath a surface in some embodiments, while in other embodiments, other heating technologies, e.g., thick film heaters, resistance wire heaters, etc. may be used. Each temperature sensor 108 is generally configured to sense a surface temperature near or on a surface being monitored, and in some instances, a temperature sensor 108 may be integrated directly into a heater assembly. In other instances, however, each temperature sensor may be separate from any heater, but disposed in proximity thereto.

Controller 102 may utilize temperature sensors 108 to monitor surface temperatures for the purpose of determining when to dynamically activate and/or deactivate the associated heaters 106 in a zone 104. In addition to or in lieu of temperature sensors 108, however, various additional inputs may be used in a dynamic multi-zonal anti-sweat heating system consistent with the invention. For example, an ambient temperature sensor 110 and/or ambient humidity sensor 112 may be used to determine the temperature and/or humidity of the environment within which the refrigerator is installed. In addition, input may be provided from a cooling system 114, e.g., indicating when the cooling system is currently active. Door switches 116 may be used to determine the open/closed status of various doors in the refrigerator, while a dispensing system 118 may provide information such as whether ice and/or water is currently being dispensed, whether an ice duct door is open, etc. Further, in some embodiments, a motion sensor 120 may be used to detect occupancy in the room in which the refrigerator is installed. Still further, in some embodiments, input may be received from various external devices, e.g., from an HVAC system through a network interface 124, whereby controller 102 may receive information such as whether the HVAC is currently running, to which temperature setpoint the HVAC system is currently set, ambient temperature and/or humidity sensed by the HVAC system, etc. In still other embodiments, weather information may be received over network interface 124, e.g., from a remote service, so that controller 102 may account for upcoming changes in weather such as storms that could change ambient conditions over the near future. It will be appreciated that in some embodiments, many of the aforementioned inputs may be omitted, so the invention is not limited to the particular combination of inputs illustrated in FIG. 5.

Figure 6:
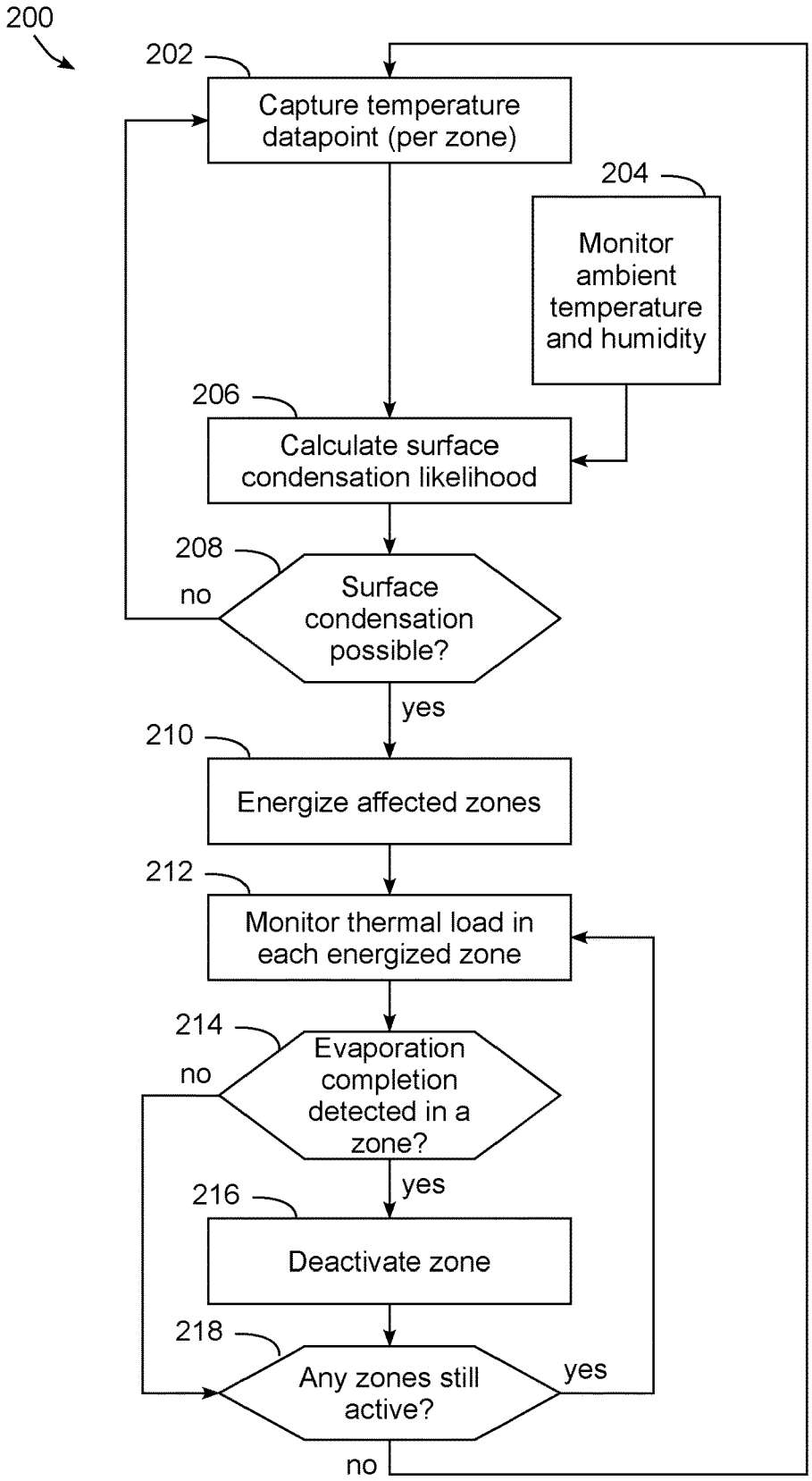
FIG. 6 is a flowchart illustrating an example sequence of operations for operating the dynamic multi-zone anti-sweat heating system of FIG. 5.

FIG. 6 illustrates an example sequence of operations 200 for dynamically monitoring and activating zones in heating system 100 of FIG. 5. Sequence 200 may be executed for all or multiple zones, for an entire heater, an entire zone, or individual heating elements within a larger array or heater. Periodically, as illustrated in block 202, a temperature datapoint is captured for each zone, representing a surface temperature sensed by the temperature sensor(s) for that zone. A surface condensation likelihood is then predicted or calculated in block 206, e.g., using a prediction algorithm based upon the captured datapoints, and as represented by block 204, also optionally based upon ambient temperature and/or humidity sensed by sensors 110, 112. Block 206, in particular, may calculate a dew point in some embodiments, and then compare a surface temperature sensed for each zone with the calculated dew point, thereby determining whether the surface temperature of one or more zones is at or below the calculated dew point, representing conditions where condensation could occur. It will be appreciated that dew point may be calculated in a number of manners in different embodiments, and may be based on ambient temperature and/or humidity as sensed by sensors 110, 112, as provided by an HVAC system 122 or via weather data. Furthermore, the frequency at which the prediction algorithm is executed may vary in different embodiments, e.g., based upon consumer behavior, such as when ice is being retrieved (based upon dispensing system 118), whether doors are open or closed (based on door switches 116), or occupancy monitoring (based on motion sensor 120) and/or based on appliance behavior, such as when the cooling system and/or fans are running (based on cooling system 114), during sealed system cycling, when ice is being produced (based on dispensing system 118), etc.

Moreover, the prediction algorithm may calculate a likelihood (e.g., in terms of a percentage) to allow for a greater or lesser chance of activating heaters, and in some instances, an energy saving function may be used to vary the prediction algorithm based upon whether or not the energy saving function is activated, e.g., to allow a greater chance of moisture and/or a lower chance of heaters being activated. A prediction algorithm may be based on a machine learning model in some embodiments, while in other embodiments, rule-based or procedural algorithms may instead be used. In many instances, however, and regardless of how implemented the likelihood of condensation may be predicted at least in part on a surface temperature measurement of a surface, so that a heater proximate to that surface may be activated whenever condensation is determined to be likely.

Thus, after the likelihood of surface condensation is predicted in block 206, block 208 either returns control to block 202 if no surface condensation is predicted, or passes control to block 210 to energize the heaters or heating elements in any affected zones (i.e., zones where condensation is determined to be likely). Thereafter, block 212 monitors the thermal load in each energized zone, and block 214 determines if evaporation has completed in any energized zone. As noted above, based upon the evaporative cooling effect, heat applied by a heater will increase the surface temperature more slowly when moisture is present on a surface as energy is expended on the phase change from liquid to gas. Thus, by monitoring for temperature spikes during activation of a heater (e.g., based on temperature sensing and/or determining a temperature rise/amperage applied ratio), the evaporation of moisture can be detected. As such, for any zone where evaporation completion is detected, block 214 may pass control to block 216 to deactivate the heater(s) in that zone, and block 218 may then determine if any other zones are still active. Returning to block 214, if no evaporation completion is detected in any zone, block 216 is bypassed and control passes directly to block 218.

If any zones are still active, block 218 returns control to block 212 to continue to monitor the thermal load in each energized zone. Then, once all zones have been deenergized, block 218 returns control to block 202 to return to periodically running the prediction algorithm to detect when condensation is likely in one or more zones.

Figure 7:
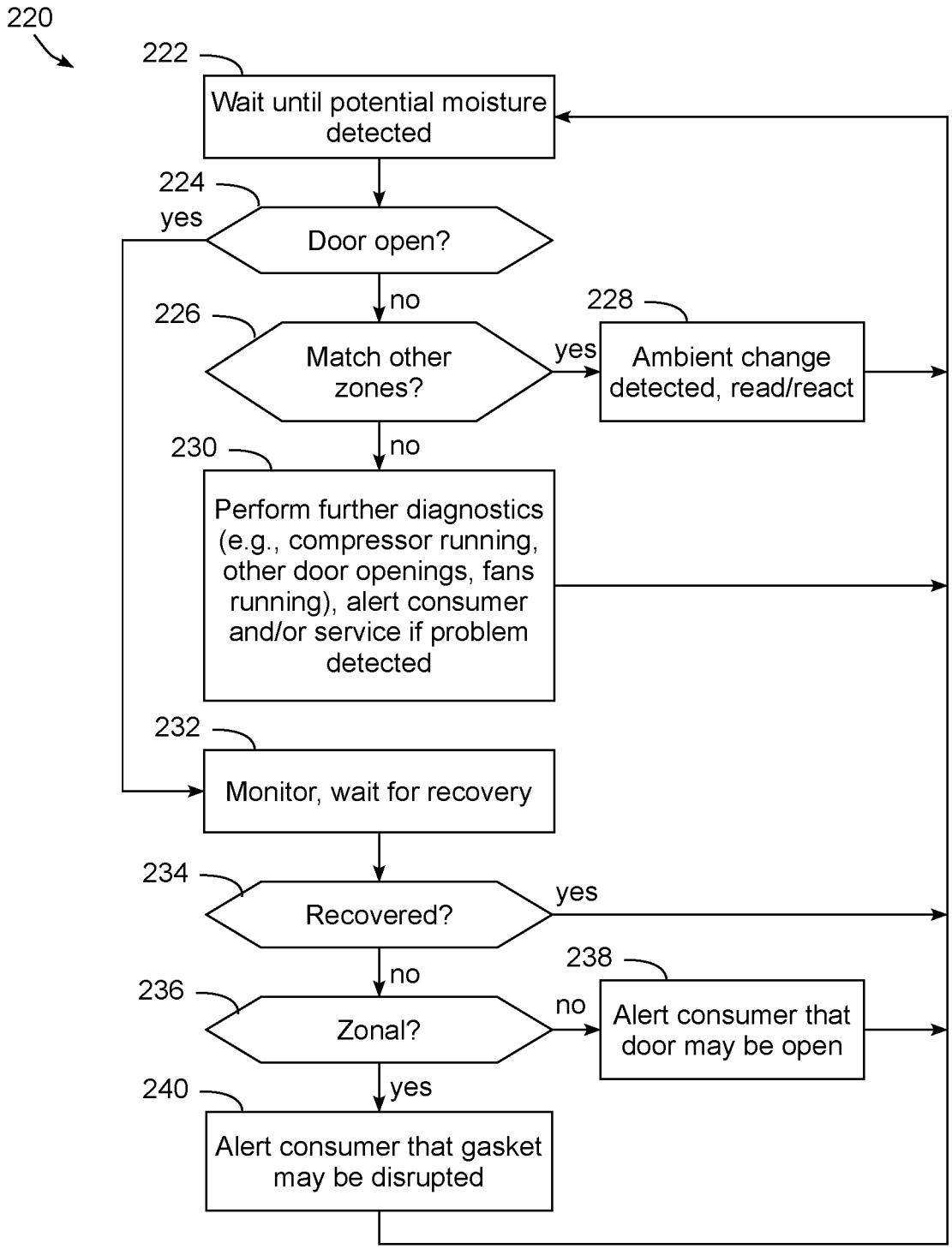
FIG. 7 is a flowchart illustrating an example sequence of operations for monitoring one or more door zones of the dynamic multi-zone anti-sweat heating system of FIG. 5.
Figure 8:
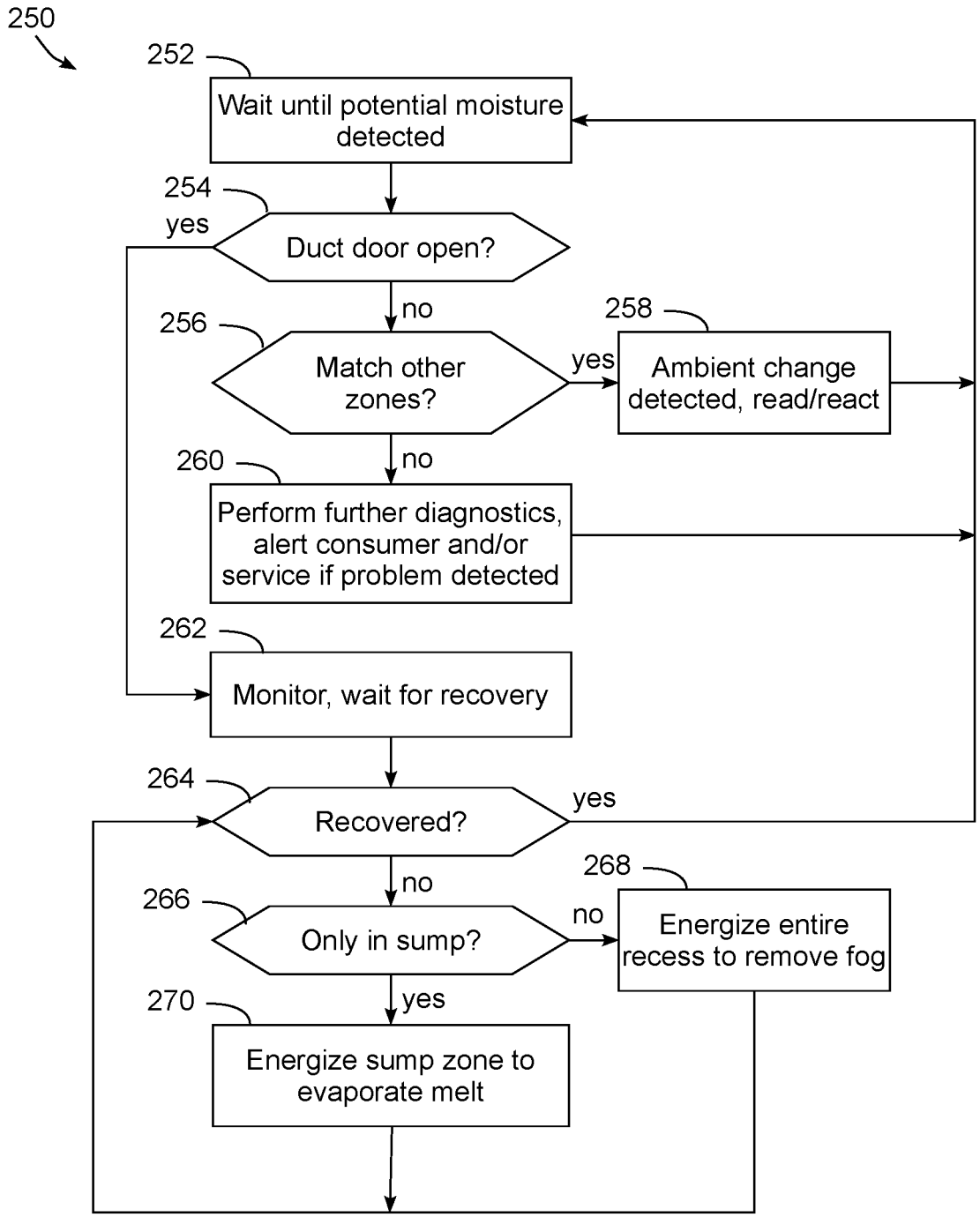
FIG. 8 is a flowchart illustrating an example sequence of operations for monitoring a dispenser recess sump zone of the dynamic multi-zone anti-sweat heating system of FIG. 5.

FIGS. 7 and 8 next illustrate two practical applications of the herein described techniques, specifically with respect to a heating system for an articulating mullion (FIG. 7) and a heating system for a dispenser recess (FIG. 8). FIG. 7, for example, illustrates a sequence of operations 220 for managing a heating zone on an articulating mullion having multiple heating zones covering different portions of the mullion (e.g., two or more zones), and which is triggered upon the detection of potential moisture in the zone in block 222 (e.g., as a result of running the prediction algorithm discussed above in connection with blocks 202-208 of FIG. 6). If potential moisture in the zone is detected, block 224 determines whether the door is open (e.g., based upon the status of a door switch). If not, control passes to block 226 to determine if other zones have similarly detected the potential for moisture, and if so, control passes to block 228 to monitor the zone and activate the heater as necessary, e.g., using the operations described above in connection with blocks 210-218 of FIG. 6). If, however, other zones are not sensing the potential for moisture, block 226 passes control instead to block 230 to perform further diagnostics, e.g., evaluating whether the compressor is running, whether other doors are open, whether any fans are running, etc., and potentially alerting a consumer or a service organization of a potential problem with the zone. The alert may take different forms in different embodiments, e.g., audible alerts such as beeps and/or synthesized speech, visual alerts such as indicator lights, LEDs, text and/or graphics on a display, or messages communicated to a remote device such as a mobile device, a cloud service, or other computing device. The alerts may be generated, for example, in response to determining that there may be problem with the door, the articulating mullion, or the heater in the zone being evaluated. Upon completion of either block 228 or block 230, control returns to block 222 to wait for detection of potential moisture.

Returning to block 224, if the door is determined to be opened, control passes to block 232 to continue to monitor the zone for potential moisture, specifically to determine if the moisture is sufficiently removed within a predetermined period of time (e.g., using the operations described above in connection with blocks 210-218 of FIG. 6). If so, block 234 determines that the zone has recovered, and control returns to block 222. If not, however, control passes to block 236 to determine if the issue is zonal, i.e., that the continued detection of moisture is not being sensed by all zones. If not zonal, meaning all zones are sensing the same conditions, it is possible that the door is still open, so control passes to block 238 to alert the consumer that the door may be open (e.g., using any of the audible, visual or message formats discussed above), then returning to block 222. If zonal, however, control passes to block 240 to alert the consumer that a potential exists that the door gasket may be disrupted, and optionally, within which zone the disruption is predicted to exist. Control then returns to block 222.

FIG. 8 illustrates a sequence of operations 250 for managing a heating zone in a dispenser recess sump, where an additional zone is provided elsewhere in the dispenser recess (e.g., on a back wall thereof), and which is triggered upon the detection of potential moisture in the zone in block 252 (e.g., as a result of running the prediction algorithm discussed above in connection with blocks 202-208 of FIG. 6). If potential moisture in the zone is detected, block 254 determines whether the duct door for the dispenser is open (e.g., based upon the status of a duct door switch), which indicates that ice is currently being dispensed by the dispenser. If not, control passes to block 256 to determine if other zones (e.g., the other dispenser recess zone) have similarly detected the potential for moisture, and if so, control passes to block 258 to monitor the zone and activate the heater as necessary, e.g., using the operations described above in connection with blocks 210-218 of FIG. 6). If, however, other zones are not sensing the potential for moisture, block 256 passes control instead to block 260 to perform further diagnostics, e.g., evaluating whether water is leaking or dribbling from the water dispenser, ice is melting or dripping from the ice dispenser, and potentially alerting a consumer or a service organization of a potential problem with the zone. The alert may take different forms in different embodiments, e.g., audible alerts such as beeps and/or synthesized speech, visual alerts such as indicator lights, LEDs, text and/or graphics on a display, or messages communicated to a remote device such as a mobile device, a cloud service, or other computing device. Upon completion of either block 258 or block 260, control returns to block 252 to wait for detection of potential moisture.

Returning to block 254, if the duct door is determined to be opened, and thus ice is currently being dispensed, control passes to block 262 to continue to monitor the zone for potential moisture, specifically to determine if the moisture is sufficiently removed within a predetermined period of time (e.g., using the operations described above in connection with blocks 210-218 of FIG. 6). If so, block 264 determines that the zone has recovered, and control returns to block 252. If not, however, control passes to block 266 to determine if the issue is zonal, i.e., that the continued detection of moisture is not being sensed by all zones, but only in the sump. If not only in the sump, it is possible that fogging is occurring within the recess, so control passes to block 268 to energize all of the zones in the dispenser recess to remove the fog, and control then returns to block 264 to wait for recovery. If only in the sump, however, the cause of the moisture may be the presence of fluids in the sump, so block 266 passes control to block 270 to energize the sump zone to evaporate any fluids retained within the sump. Control then returns to block 264 to wait for recovery, which occurs when the fluid has fully evaporated from the sump.

It will be appreciated that the various features and techniques disclosed herein may be used separately from one another or in various combinations, so the specific applications of the herein-described techniques in association with particular surfaces of a refrigerator may be implemented separately in different embodiments. Other modifications will be apparent to those of ordinary skill in the art having the benefit of the instant disclosure. Therefore, the invention lies in the claims hereinafter appended.

What is claimed is:

1. A refrigerator, comprising:

a cabinet including one or more food compartments and one or more doors providing external access to the one or more food compartments;

a surface heater positioned to heat a surface of the cabinet;

a temperature sensor positioned to sense a temperature for the surface; and a controller coupled to the surface heater and the temperature sensor, the controller configured to detect moisture on the surface by performing each of:

activating the surface heater;

sensing temperature with the temperature sensor; and determining that moisture is present on the surface in response to detecting an elevated thermal load on the surface while the surface heater is activated.

2. The refrigerator of claim 1, further comprising an articulating mullion disposed on one of the one or more doors, wherein the surface is disposed on the articulating mullion.

3. The refrigerator of claim 2, wherein the controller is further configured to generate an alert indicating that a door among the one or more doors has been left open in response to a temperature sensed by the temperature sensor.

4. The refrigerator of claim 2, wherein the controller is further configured to generate an alert indicating that a gasket of a door among the one or more doors may be disrupted in response to a temperature sensed by the temperature sensor.

5. The refrigerator of claim 1, further comprising an externally-mounted dispenser disposed on the cabinet and including a dispenser recess sump, wherein the surface is disposed on the dispenser recess sump.

6. The refrigerator of claim 5, wherein the controller is further configured to generate an alert indicating a presence of fluid in the dispenser recess sump in response to a temperature sensed by the temperature sensor.

7. The refrigerator of claim 5, wherein the surface is a first surface, the surface heater is a first surface heater, and the temperature sensor is a first temperature sensor, wherein the refrigerator further comprises a second surface heater positioned to heat a second surface in a dispenser recess and a second temperature sensor positioned to sense a temperature for the second surface, wherein the controller is further configured to detect moisture on the second surface by performing each of activating the second surface heater, sensing temperature with the second temperature sensor, and determining that moisture is present on the second surface in response to detecting an elevated thermal load on the second surface while the second surface heater is activated, and wherein the controller is further configured to separately detect moisture on the first and second surfaces and to separately activate the first and second surface heaters based upon moisture respectively detected on the first and second surfaces.

8. The refrigerator of claim 1, wherein the surface is a first surface, the surface heater is a first surface heater, and the temperature sensor is a first temperature sensor, wherein the refrigerator further comprises a second surface heater positioned to heat a second surface of the cabinet and a second temperature sensor positioned to sense a temperature for the second surface, wherein the controller is further configured to detect moisture on the second surface by performing each of activating the second surface heater, sensing temperature with the second temperature sensor, and determining that moisture is present on the second surface in response to detecting an elevated thermal load on the second surface while the second surface heater is activated, and wherein the controller is further configured to separately detect moisture on the first and second surfaces and to separately activate the first and second surface heaters based upon moisture respectively detected on the first and second surfaces.

9. The refrigerator of claim 1, further comprising an evaporative tray disposed on the cabinet, wherein the surface is disposed on the evaporative tray.

10. The refrigerator of claim 1, wherein the controller is configured to determine the elevated thermal load based upon a rate of temperature rise during activation of the surface heater.

11. The refrigerator of claim 1, wherein the controller is configured to determine the elevated thermal load based upon a comparison of temperature rise with applied current to the heater.

12. The refrigerator of claim 1, wherein the controller is further configured to, in addition to activating the surface heater when detecting moisture on the surface, predict a likelihood of condensation forming on the surface based upon the temperature sensed by the temperature sensor, and activate the surface heater in response to predicting that condensation is likely to be forming on the surface.

13. The refrigerator of claim 12, wherein the controller is further configured to predict the likelihood of condensation forming on the surface based upon ambient temperature and/or humidity sensed by one or more additional sensors of the refrigerator.

14. The refrigerator of claim 12, wherein the controller is configured to predict the likelihood of condensation by executing a prediction algorithm, and wherein the controller is configured to dynamically execute the prediction algorithm in response to consumer or appliance behavior.

15. The refrigerator of claim 14, wherein the controller is configured to dynamically execute the prediction algorithm in response to detected ice retrieval, detected door opening, occupancy monitoring, sealed system cycling, fan operation and/or ice production.

16. The refrigerator of claim 12, wherein the controller is configured to predict the likelihood of condensation by executing a prediction algorithm, and wherein the controller is configured to dynamically execute the prediction algorithm in response to ambient monitoring or input received from an HVAC system.

17. The refrigerator of claim 1, wherein the temperature sensor is integrated into the surface heater.

18. A refrigerator, comprising:

a cabinet including one or more food compartments and one or more doors providing external access to the one or more food compartments, the cabinet further including a fluid receptacle for receiving and containing fluid;

a heater positioned to heat the fluid receptacle;

a temperature sensor positioned to sense a temperature proximate the fluid receptacle; and a controller coupled to the heater and the temperature sensor, the controller configured to activate the heater to evaporate fluid disposed in the fluid receptacle, the controller further configured to automatically deactivate the heater when the fluid disposed in the fluid receptacle has been evaporated based upon the temperature sensed by the temperature sensor.

19. The refrigerator of claim 18, further comprising an externally-mounted dispenser disposed on the cabinet, wherein the fluid receptacle comprises a dispenser recess sump for the externally-mounted dispenser.

20. The refrigerator of claim 18, wherein the fluid receptacle comprises an evaporative tray configured to collect condensation generated by a cooling system of the refrigerator.

21. The refrigerator of claim 18, wherein the controller is configured to determine when the fluid disposed in the fluid receptacle has been evaporated by determining a decrease in thermal load in the fluid receptacle while the heater is activated.

22. The refrigerator of claim 21, wherein the controller is configured to determine the decrease in thermal load by detecting an increased temperature rise during activation of the heater.

23. The refrigerator of claim 21, wherein the controller is configured to determine the decrease in thermal load based upon a comparison of temperature rise with applied current to the heater.

24. The refrigerator of claim 18, wherein the controller is further configured to detect moisture in the fluid receptacle in response to detecting an elevated thermal load in the fluid receptacle while the surface heater is activated.

25. A refrigerator, comprising:

a cabinet including one or more food compartments and one or more doors providing external access to the one or more food compartments;

a plurality of surface heaters positioned to heat respective surfaces among a plurality of surfaces of the cabinet;

a plurality of temperature sensors positioned to sense temperatures for respective surfaces among the plurality of surfaces; and a controller coupled to the plurality of surface heaters and the plurality of temperature sensors, the controller configured to detect moisture on a selected surface of the plurality of surfaces by performing each of:

activating the respective surface heater for the selected surface;

sensing temperature with the respective temperature sensor for the selected surface; and determining that moisture is present on the selected surface in response to detecting an elevated thermal load on the selected surface while the surface heater for the selected surface is activated.

* * * * *